US005622065A

United States Patent [19]

Persiano

[11] Patent Number: 5,622,065

[45] Date of Patent: Apr. 22, 1997

[54] LOCKING MECHANISM

[76] Inventor: Anthony M. Persiano, 1809 Edgewood Pl., Clementon, N.J. 08021

[21] Appl. No.: 554,190

[22] Filed: Nov. 6, 1995

[51] Int. Cl.[6] ..... E05B 65/06

[52] U.S. Cl. ..... 70/139; 70/105; 292/195

[58] Field of Search ..... 70/139, 135, 136, 70/137, 138, 105; 292/195, 196, 197, 198, 200

[56] References Cited

U.S. PATENT DOCUMENTS

| | | | |
|---|---|---|---|
| 2,854,839 | 10/1958 | Eads | 70/139 |
| 3,103,804 | 9/1963 | Wood et al. | 70/139 |
| 3,479,851 | 11/1969 | Davidson et al. | 70/451 |
| 3,659,885 | 5/1972 | Nail | 292/2 |
| 3,695,068 | 10/1972 | Eads et al. | 70/107 |
| 3,740,979 | 6/1973 | Crepinsek | 70/139 |
| 3,899,906 | 8/1975 | Bradstock | 70/139 |
| 4,126,341 | 11/1978 | Bradstock | 292/101 |
| 4,127,016 | 11/1978 | Ibsen | 70/92 |
| 4,218,903 | 8/1980 | Eads | 70/107 |
| 4,576,023 | 3/1986 | Crepinsek | 70/137 |
| 4,604,878 | 8/1986 | Todd et al. | 70/139 |
| 4,663,950 | 5/1987 | Mascotte | 70/135 |
| 5,452,927 | 9/1995 | Uyeda | 292/202 |

FOREIGN PATENT DOCUMENTS

| | | | |
|---|---|---|---|
| 2014230 | 8/1979 | United Kingdom | 70/139 |

*Primary Examiner*—Rodney M. Lindsey
*Assistant Examiner*—Donald J. Lecher
*Attorney, Agent, or Firm*—Lennox & Murtha, P.A.

[57] ABSTRACT

A locking mechanism includes a lock cylinder cam urging a split link between which a drive pin engages a generally horizontal slot in an actuator member limited to rectilinear movement with a horizontal pin riding in a vertical slot and engaged in a radial slot in a swinging lock bolt. The split link posts ride in ninety degree arcuate slots with straight horizontal and vertical escape sections at the ends of the slots. Sliding brackets hold a choice of lock cylinders including the slim line types.

23 Claims, 4 Drawing Sheets

26
92
94
96
102
104
22
66
86
97
100
98
62
70
176
51
178
134
118
88
76
176'
132
122
145
144
116
120
136
138
90
78
50
178'
152
140
154
176"
34
178"
46
180
170
182
51
80
146
147
142
74
72
40
172
186
184
180'
182'
164
148
158
174
180"
41
48
51
182"
26'
92'
107
114
106
94'
30
22
66'
108
86'
62'
112
110

LOCKING MECHANISM

BACKGROUND OF THE INVENTION

This invention is directed to a lock mechanism and more particularly to a lock mechanism used in the narrow stiles of high security doors generally used in non residential type buildings.

While a wide variety of high security lock mechanisms have been disclosed, style AR1850 marketed by Adams Rite Manufacturing Company of Glendale, Calif., is in very wide use almost to the exclusion of other locking mechanisms. This lock mechanism is described in U.S. Pat. No. 4,218,903 to Eads, assigned to Adams Rite. For the past 40 years lock mechanisms used on narrow stile doors including sliding doors have been reported to have some serious security problems as a result of their mechanical design. Various costly external devices have been devised to deal with several of these problems. These devices are only marginally effective. Common techniques used to unlawfully open these locks include using a wrench to twist the lock cylinder breaking the set screw holding the cylinder from turning. Rotating ring collars that are recommended to prevent using this technique add expense and are only marginally effective in deterring wrenching the cylinder. A second method is to drill a hole through the wall of the door stile into which a probe aligned with the spring latch is used to disengage the spring loaded latch of the lock. Using a third method these types of locks are also susceptible to the use of a hook constructed of flat spring steel, which in the hands of a skilled burglar, allows easy entry into the premises. A fourth method requires no mechanical skill. This method does require the person to gain access to the lock while it is unlocked and surreptitiously insert a thin metal shim such that when the lock is engaged by the end user, the shim interferes with the latching mechanism. While the lock mechanism appears to be locked, slight shaking of the lock bolt causes the lock bolt to disengage. After entry, these locks can be relocked with an L-shaped tool, leaving no trace of illegal entry and thus reducing the chance of quick appropriate law enforcement action. While the first and second methods could be considered forced entry which leave evidence of the method used, the third and fourth methods leave no marks or evidence of how entry was accomplished. This is of particular concern for the end user leading to possible false conclusions such as that the door was left unlocked or that entry was made by use of a duplicate key.

The lock mechanism described in U.S. Pat. No. 4,218,903 to Eads, utilizes a retainer pin that is moved through an arcuate slot which in turn is engaged in a swinging actuator lever which moves the swinging bolt. The bolt is secured in the retracted unlocked position and in the extended locked position by a spring-urged latch. In U.S. Pat. No. 3,899,906 to Bradstock, with a casement type cylinder, an insertable lock mechanism using a rocker lever to transmit movement of the lock cylinder cam to a swingable bolt utilizes a spring-urged latch similar to Eads to maintain the bolt in a locked position. A standard lock mounting mechanism for narrow stile door frames is described in U.S. Pat. No. 3,479,851 to Davidson, et al. A swinging bolt construction described in U.S. Pat. No. 3,659,885 to Nail is a narrow stile latch-lock mechanism utilizing a swinging, pivoted hook operable by a latch handle and utilizing a swinging actuating lever to move the latch hook. In U.S. Pat. No. 4,126,341 to Bradstock, a self-contained electric power driven bolt actuating unit in a high security door utilizes a actuator shaft connected at one end with a bolt actuating cam utilizing a swinging actuator lever engaging the swinging bolt.

None of these devices satisfy the needs and associated problems with the present locking mechanisms or do not attain the objects described herein below.

SUMMARY OF INVENTION

It is an object of the protection sought to provide a lock mechanism that essentially prevents use of any and all of the techniques described herein above to gain illegal entry and defeat the lock system effectively resolving the limited security associated with the swing bolt locks predominantly used in narrow stile doors.

It is an object of the protection sought to provide a lock mechanism that utilizes a linear movement of an actuator lever transmitting the rotational movement of the lock cylinder cam to the rotational movement of the swinging bolt.

It is also an object of the protection sought to provide a lock mechanism that does not utilize a spring-urged latch to secure the actuator lever in position when the bolt is in the locked or in the retracted position. It is a further object to avoid using a latch located on the outer walls of the lock casing which is accessible by means of penetration into the door stile to allow movement of the latch, disarming the mechanism, and opening the door.

It is an additional object of the protection sought to provide a lock mechanism that is more difficult to remove from the door when the lock mechanism is not in the locked condition.

It is an object of the protection sought to provide a lock mechanism that can accommodate clearance holes either pre drilled or premarked for drilling later to accommodate through bolts for purposes of attaching door handles, plates for armoring and other devices to the door without interfering with the locking mechanism or the security thereof.

It is an object of the protection sought to provide a lock mechanism that is serviceable and accessible and uses screws instead of rivets for assembly, which allows, for example, to install extension actuators to provide additional locking features, including two and three point interlocks or to exchange locking bolts, such as from straight to hook type bolt.

It is also an object of the protection sought to provide a locking mechanism with intergatable brackets to allow installation of a wide variety of lock cylinders including slim line insertable lock cylinders. This wide variety of lock cylinder types includes lock cylinders that have an external shape with flat sides, such as a non threaded casement variety that when engaged into the bracket within the interior of the door stile cannot be forcefully rotated, pulled out, or punched in to gain access to the lock mechanism, as well as, various design possibilities involving insertable locking cylinders, all of which are adaptable to same lock casing.

It is a further object of the protection sought to provide a locking mechanism, with its related component lock cylinder brackets designed for retrofit, which is retrofittable to existing door stiles as well as preexisting lock cylinders, requiring no alterations or expensive, time consuming modifications. Whereas in new installations, the superior insertable slim-line lock cylinders can be used as appropriate cut-outs can be made to match the profile of the cylinder.

It is an object of the protection sought to provide a lock mechanism with an accessible lock casing to accommodate which a swinging lock bolt with or without a hook-shape on the end.

It is a further object of the protection sought to provide multiple and redundant locking of the elements of the mechanism in both the retracted and locking positions.

It is an additional object of the protection sought to provide a locking mechanism which cannot be opened by subjecting it to intense vibration.

It is a further object of the present invention to provide a locking mechanism with less moving parts less parts that are subject to wear, and more reliable parts, particularly avoiding the use of springs to achieve escape, drive movement or latching of the actuator. It is also an object to provide a locking mechanism to allow reintegration of the separate component parts and elements of the system including the lock cylinder, retaining brackets, the lock casing and the like.

It is an additional object of the protection sought to allow use of a 360 degree key removal to provide additional security requiring that the key must rotate 360 degrees to either lock or unlock, after which the key can be removed.

It is an additional object of the protection sought to provide a more compact lock mechanism which does not require use of the outer walls to achieve latching making these other mechanisms more accessible to unwanted intrusion.

It is a particular object of the protection sought to provide a lock cylinder housing that serves as an additional barrier to the latching mechanism.

It is an additional object of the protection sought to provide a lock mechanism that, through the use of natural barriers and rectilinear motion of the actuator lever moving the lock bolt that avoids the necessity of placement of added barriers to preempt the use of lock defeating devices.

An aspect of the invention is a locking mechanism for use in a movably mounted door. The door includes a stile with an opening in a vertical face thereof adjacent a face of a frame in which the door is mounted, and a lock actuating means to operate a cam member thereof rotatable in opposite directions in a vertical arc. The locking mechanism includes a lock casing insertable in the opening in the stile and means to attach the casing in the stile, the casing comprising a front facing out of the opening in the stile. The locking mechanism further includes a lock bolt moving alternatively through the opening in the casing from a retracted position to a locking position wherein the bolt in the locking position extends frontwardly into the face of the frame of the door. The locking mechanism further includes a split link dual post crank pin assembly that includes a pair of link members each including vertical faces facing in opposite directions, each link member including a pair of separated posts extending laterally from said vertical face, wherein a post on each link is aligned with a post on the other link, and a crank member extending between a pair of the aligned posts. The locking mechanism further includes means to guide movement of said assembly in a vertical arc of the link members as a pair of the posts on one link is urged by the cam member, first against one post in one direction along the arc and then against the remaining post in an opposite direction along the arc, to allow escape of the posts urged by the cam member at the ends of the arc, and to effect a latched condition at an end corresponding to the locked position. The locking mechanism further includes means to transfer movement of the crank member to move the lock bolt, and alternatively secure the lock bolt in the locking position or the retracted position including automatically latching said means. The means preferably includes automatic latching of the latchbolt in the retracted position and not the means to transfer movement of the crank member to the lock bolt.

While the lock bolt may slide or swing it is preferred that it be a swinging lock bolt swinging on a pivot pin, the bolt alternatively swinging through the opening in the casing from a vertical retracted position to a horizontal locking position wherein the bolt in the locking position extends frontwardly into the face of the frame. It is more preferred that the lock bolt swing on a fixed pivot pin attached to the casing, the pin having a central pivot axis. It is further preferred that the means to transfer movement of the crank member to move the lock bolt, and alternatively secure the lock bolt in the locking position or the retracted position include an actuator member that includes a generally horizontal slot in an upper section of the actuator member through which the crank member engages, a lower section, and engagement means on said lower section to engage the lock bolt as the actuator is moved vertically moving the lock bolt back and forth between the locking position and the retracted position, as the actuator member is moved to an upper position to engage a bearing surface thereof against a first bearing surface of the lock bolt when the lock bolt is in the retracted position, and as the actuator member is moved to a lower position to engage the bearing surface thereof against a second bearing surface of the lock bolt when the lock bolt is in the locking position, and that the mechanism also include holding means in the casing to hold the actuator member and limit it to freely slide rectilinearly vertically downwardly and upwardly. It is more preferred that the engagement means on the actuator member include a horizontal pin member extending laterally from the lower section of the actuator member in opposite directions, the horizontal pin member being positioned to engage a slot in the lock bolt as the actuator is moved vertically moving the lock bolt, abut the first bearing surface of the lock bolt when the lock bolt is in the retracted position, and abut the second bearing surface of the lock bolt when the lock bolt is in the locking position.

Another aspect of the invention is a locking mechanism for use in a movably mounted door. The door includes a stile and a lock actuating means a herein above described. The locking mechanism includes a lock casing and a lock bolt as described herein above. The mechanism further includes an actuator member that includes an upper section, a lower section, and engagement means on said lower section to engage the lock bolt as the actuator is moved vertically moving the lock bolt back and forth between the locking position and the retracted position, as the actuator member is moved to an upper position to engage a bearing surface thereof against a first bearing surface of the lock bolt when the lock bolt is in the retracted position and as the actuator member is moved to a lower position to engage the bearing surface thereof against a second bearing surface of the lock bolt when the lock bolt is in the locking position. The mechanism further includes translating means to engage the cam member and the upper portion of the actuator member and translate rotational movement of the cam member to vertical movement of the actuator member and holding means in the casing to hold the actuator member and limit it to freely slide rectilinearly vertically downwardly and upwardly. The mechanism further includes escape means to allow escape of the translating means at ends of movement of the actuator member, and latching means to prevent movement of the lock bolt when the lock bolt is in the retracted position and when the lock bolt is in the locking position. While a preferred embodiment includes the actuator in a vertical position, it is clear that the actuator may be horizontal and may even include a sliding bolt.

It is preferred that the lock bolt be a swinging lock bolt as described herein above and that the actuator member comprises a horizontal pin member also as described herein above. It is also preferred that the translating means include a split link dual post crank pin assembly that includes a pair of link members each including vertical faces facing in opposite directions, each link member including a pair of separated posts extending laterally from said vertical face, wherein a post on each link is aligned with a post on the other link, and a crank member extending through and engaging a generally horizontal cross slot in the actuator member between a pair of the aligned posts. It is further preferred that the translating means include means to guide movement of said assembly in a vertical arc of the link members as a pair of the posts on one link is urged by the cam member, first against one post in one direction along the arc and then against the remaining post in an opposite direction along the arc, and to allow escape of the post urged by the cam member at the ends of the arc.

Yet another aspect of the invention is a locking mechanism for use in a movably mounted door. The door includes a stile and a lock actuating means as described herein above. The locking mechanism includes a lock casing insertable in the opening in the stile and means to attach the casing in the stile, the casing including a front facing out of the opening in the stile. The locking mechanism further includes a swinging lock bolt swinging on a pivot pin, the pin having a central pivot axis, the bolt alternatively swinging through the opening in the casing from a vertical retracted position to a horizontal locking position wherein the bolt in the locking position extends frontwardly into the face of the frame. The lock bolt includes a transverse angled slot in the lock bolt angled radially from the pivot pin upwardly and rearwardly when the lock bolt is in the retracted position, a first face juxtaposed above an opening of said slot disposed vertically facing rearwardly when the lock bolt is in the retracted position, a second face juxtaposed below the opening of said slot disposed vertically when the lock bolt is in the locking position, and a lateral vertical slot opening upwardly when the lock bolt is in the retracted position. The mechanism further includes means to transfer movement by the cam member to swing the lock bolt back and forth between the horizontal locking position and the vertical retracted position of the lock bolt, and to secure the lock bolt in the locking position by bringing a member to engage the second face of the lock bolt preventing movement thereof when the lock bolt is in the locked position, and secure the lock bolt in the retracted position by bringing said member to engage the second face of the lock bolt preventing movement thereof when the lock bolt is in the retracted position.

It is preferred that the lock bolt swing on a fixed pivot pin attached to the casing, the pin having a central pivot axis. It is further preferred that the means to transfer movement of the crank member to move the lock bolt, and alternatively secure the lock bolt in the locking position or the retracted position include an actuator member that includes a generally horizontal slot in an upper section of the actuator member through which the crank member engages, a lower section, and engagement means on said lower section as described herein above. It is also preferred that the means to transfer movement by the cam member to swing the lock bolt back and forth between the horizontal locking position and the vertical retracted position of the lock bolt, and to secure the lock bolt in the locking position include a split link dual post crank pin assembly as described herein above, and means to guide movement of said assembly in a vertical arc of the link members as a pair of the posts on one link is urged by the cam member, first against one post in one direction along the arc and then against the remaining post in an opposite direction along the arc, and to allow escape of the post urged by the cam member at the ends of the arc.

Another aspect of the invention is a locking mechanism for use in a movably mounted door, the door including a stile, that is preferably of a relatively narrow configuration, with an opening and at least one lock cylinder housing enclosing means to house a lock actuating means to transfer manual movement directed to said means to rotate a cam member thereof in opposite directions in a vertical arc. The locking mechanism includes a lock casing insertable in the opening in the stile and means to attach the casing in the stile. The casing includes a front facing out of the opening in the stile, and at least one open longitudinal channel, one for each lock cylinder housing, each channel comprising an open vertical face facing toward the cam member, a horizontal upper side face and a horizontal lower side face. The mechanism includes at least one bracket, one for each lock cylinder housing, horizontally slideably engaged in the open channel, the bracket including connecting means to connect the lock cylinder housing to the bracket and prevent removal or twisting of the lock cylinder. The mechanism further includes tongue and groove means on the side faces of the channel and the bracket to allow the bracket to slide longitudinally in the casing and prevent any movement of the bracket laterally. The mechanism further includes means to detachably attach the bracket to the casing and a lock bolt alternatively moving through the opening in the casing from a retracted position to a locking position wherein the bolt in the locking position extends frontwardly into the face of the frame. The mechanism further includes means to translate rotational movement of the cam member to swinging movement of the lock bolt.

It is again preferred that the lock bolt be a swinging lock bolt as described herein above. It is again preferred that the means to translate rotational movement of the cam member to movement of the lock bolt include a split link dual post crank pin assembly as described herein above and means to translate movement of the crank member to movement of the lock bolt. It is again preferred that the means to transfer movement of the crank member to move the lock bolt, and alternatively secure the lock bolt in the locking position or the retracted position include an actuator member as described herein above and further that the engagement means include a horizontal pin member as described herein above.

Another aspect of the invention is locking mechanism for use in a movably mounted door as described herein above. The locking mechanism includes a lock casing insertable in the opening and a swinging lock bolt as described herein above. The lock bolt includes a transverse angled slot in the lock bolt angled radially from the pivot pin upwardly and rearwardly when the lock bolt is in the retracted position, a first face juxtaposed above an opening of said slot disposed vertically facing rearwardly when the lock bolt is in the retracted position, a second face juxtaposed below the opening of said slot disposed vertically when the lock bolt is in the locking position, and a lateral vertical slot opening upwardly when the lock bolt is in the retracted position. The locking mechanism further includes an actuator member that includes a generally horizontal cross slot, a lower section extending into the lateral vertical slot in the lock bolt, and a horizontal pin member extending laterally from the lower section of the actuator member in opposite directions parallel to the central axis of the pivot pin. The horizontal pin member is positioned to engage in the slot in the lock bolt as the actuator is moved vertically swinging the lock bolt, abut the first face when the lock bolt is in the retracted position, and abut the second face when the lock bolt is in the locking position. The locking mechanism further includes means in the casing to hold the actuator member and allow it to freely slide a rectilinear distance vertically downwardly and upwardly in response to translating means to translate rotational movement of the cam member to vertical movement of the actuator member, to allow escape of the translating means at ends of movement of the actuator member, to effect a three point fix of the mechanism in the locked position of the movement of the translating means.

Yet another aspect of the invention is a locking mechanism for use in a movably mounted door having a relatively narrow stile. The door includes a stile with an opening in a vertical face thereof adjacent a face of a frame in which the door is mounted, and a lock actuating means that includes at least one lock cylinder housing enclosing means to transmit manual movement directed to said means to rotate a cam member in opposite directions in a vertical arc. The locking mechanism includes a lock casing insertable in the opening in the stile and means to attach the casing in the stile. The casing includes a front facing out of the opening in the stile, and an open longitudinal channel, one for each lock cylinder housing, that includes an open vertical face facing toward the cam member, a horizontal upper side face and a horizontal lower side face. The locking mechanism further includes a bracket, one for each lock cylinder housing, horizontally slideably engaged in the open channel, the bracket that includes connecting means to connect the lock cylinder housing to the bracket and prevent removal or twisting of the lock cylinder. The locking mechanism further includes tongue and groove means on the side faces of the channel and the bracket to allow the bracket to slide longitudinally in the casing and prevent any movement of the bracket laterally and means to detachably attach the bracket to the casing to position the lock cylinder cam to engage the lock mechanism further described herein below. The locking mechanism further includes a swinging lock bolt swinging on a fixed pivot pin attached to the casing, the pin having a central pivot axis, the bolt alternatively swinging through the opening in the casing from a vertical retracted position to a horizontal locking position wherein the bolt in the locking position extends frontwardly into the face of the frame. The lock bolt includes a transverse angled slot in the lock bolt angled radially from the pivot pin upwardly and rearwardly when the lock bolt is in the retracted position, a first face juxtaposed above an opening of said slot disposed vertically facing rearwardly when the lock bolt is in the retracted position, a second face juxtaposed below the opening of said slot disposed vertically when the lock bolt is in the locking position, and a lateral vertical slot opening upwardly when the lock bolt is in the retracted position. The locking mechanism further includes a pair of vertically aligned track guide slots cut horizontally in the casing, each of said slots. Each slot includes an upper vertical straight escape section, an arcuate median section, and a lower horizontal straight escape section. The locking mechanism further includes an actuator member that includes a generally horizontal cross slot, a lower section extending into the lateral vertical slot in the lock bolt, and a horizontal pin member extending laterally from the lower section of the actuator member in opposite directions parallel to the central axis of the pivot pin. The horizontal pin member is positioned to engage in the slot in the lock bolt as the actuator is moved vertically swinging the lock bolt, abut the first face when the lock bolt is in the retracted position, and abut the second face when the lock bolt is in the locking position. The locking mechanism further includes slide means in the casing to hold the actuator member and allow it to freely slide a rectilinear distance vertically downwardly and upwardly between the aligned track guide slots, preferably including three guides, a vertical slot on each side of the lock case in which the ends of the horizontal pin member ride, a horizontal pin extending from the casing riding in a vertical slot in the actuator lever, and horizontal alignment of the crank member along the escape section from the arcuate slot to a position at least vertically above or past that point toward the bolt when the mechanism is in the locked position. The locking mechanism further includes a split link dual post crank pin assembly that includes a pair of link members each that includes vertical faces facing in opposite directions, each link member that includes a pair of separated posts extending laterally from said vertical face and riding in the respective track guide slots, wherein a post on each link is aligned with a post on the other link, and a crank member extending between a pair of the aligned posts riding in the generally horizontal cross slot in the actuator member. The posts are positioned to be actuated by the cam member.

A final aspect of the invention is a locking mechanism for a movably mounted door in a frame having a relatively narrow stile, the frame including an opening in a vertical face thereof. The mechanism includes a lock actuating means that includes a manually operated cam member rotatable in opposite directions in a vertical arc engagable through the door and attached to a casing insertable in an opening in the door. The locking mechanism may further include any or all of the following: means to attach the casing in the door a swinging lock bolt, a pair of aligned track guide slots cut horizontally in the casing, an actuator member, slide means, and a split link dual post crank pin assembly, all as described herein above.

DESCRIPTION OF PREFERRED EMBODIMENTS

Although much of the specification and the claims relate to a single cam of the standard or improved lock cylinder, it should be clear that this invention is not limited to a single cam, but rather anticipates that in most doors there will be lock cylinders on both sides of the door and that one cam will engage the posts on one link of the mechanism and a second will engage the posts of the other link of the split link mechanism.

An important element of the invention is the rectilinear (straight line) movement of the drive actuator member to translate rotating motion to rectilinear motion to motion which is reciprocal. In addition to the split link mechanism to translate the arcuate motion of the cylinder cam to the actuator member other mechanisms include rack and pinion, solid links attached to the pinion portion, or a straight lever with one end connected to the lock bolt drive pin and the other to a split link or link that is solid is possible. The split link or double follower mechanism provides three functions. It provides means for converting rotational movement to the rectilinear drive actuator; it provides means for escape of cam movement and reverse pick up; and it provides means to latch the drive actuator in lock mode. The lock mechanism is latched when the actuator, which is a modified scotch yoke, is dead locked when the crank member is brought to an escape position to or past a vertical alignment with the horizontal bolt pin extending from the actuator and engaging the bolt.

The lock cylinder housings described herein below are installed separately from the lock case itself because of the pervasive problem of wrenching a mortise cylinder due to the limited set-screw arrangement shown in the AR 1850 unit. In that unit the threaded portion in which the set-screw is being held is relatively thin metal. When only modest counter force is applied to the lock cylinder it either snaps the screw or it is pulled out of the few threads which hold it. An answer to this problem is more metal mass by which to hold the screw securely with the more support closer to the cylinder, the better. The door stile has sufficient inner hollow space to allow more metal mass dedicated to solve this problem. This requires a housing sufficient in size to allow a means to attach a lock cylinder and an improved way of retaining it. This invention allows taking advantage of this wasted space and opens up other designs for insertable cylinders which could not be done with the prior art thin-walled lock cases such as the Adams Rite 1850. The invention provides that the lock cylinder housing is reattachable by means of double track guide system similar to tongue and groove. Means are provided for accurately aligning the cam of the lock cylinder with the drive portion of the split-link dual post crank pin.

Figures 5, 5A, 6:
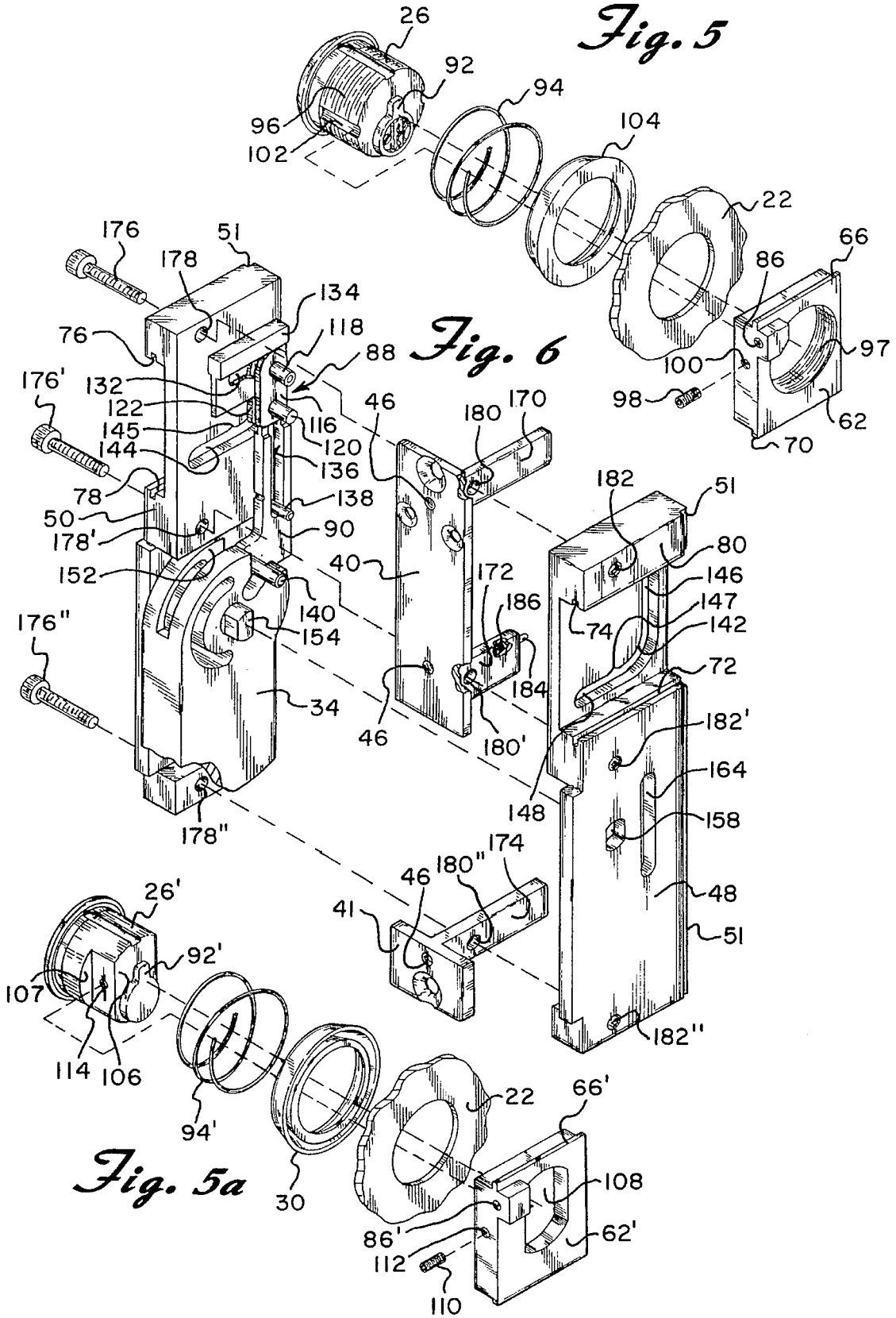
FIG. 5 is an exploded perspective view of a lock cylinder and a housing bracket attachment of the invention as shown in FIG. 4.
FIG. 5*a* is an exploded perspective view of a second embodiment of a lock cylinder and a lock cylinder housing which is interchangeable within lock case of the invention.
FIG. 6 is an exploded perspective view of the lock case and related lock mechanism exploded out in FIG. 4.
Figure 7:
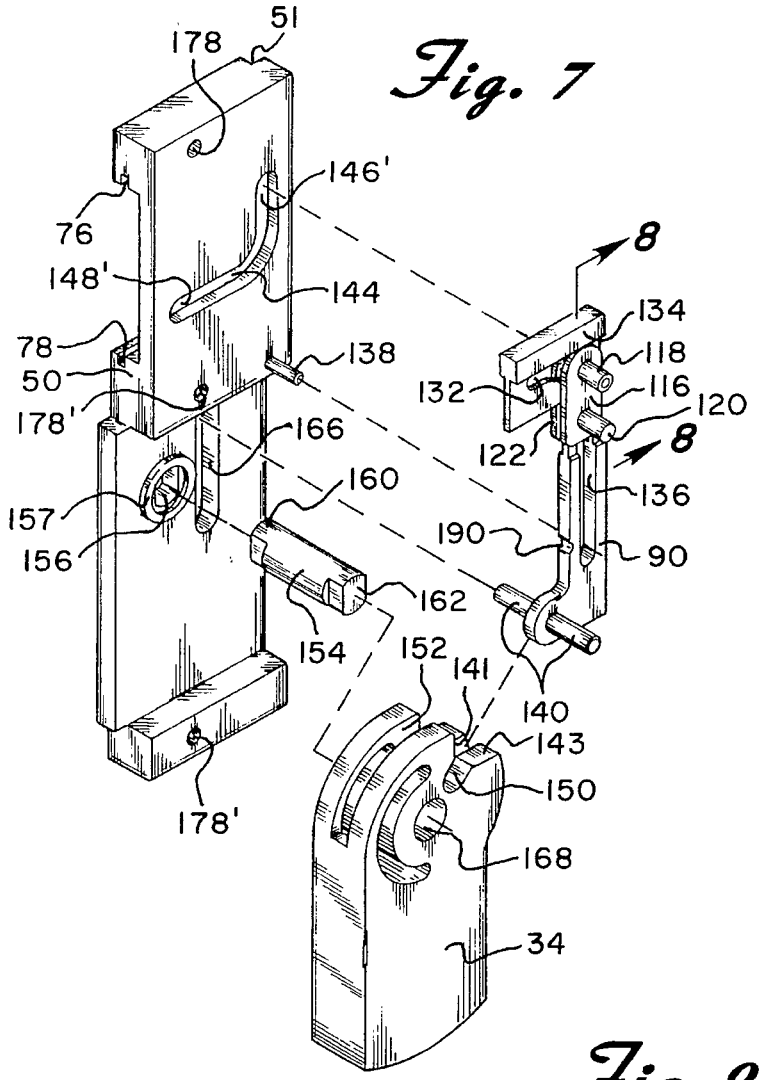
FIG. 7 is an exploded perspective view of the lock case portion of the locking mechanism exploded out in FIG. 6.
Figure 8:
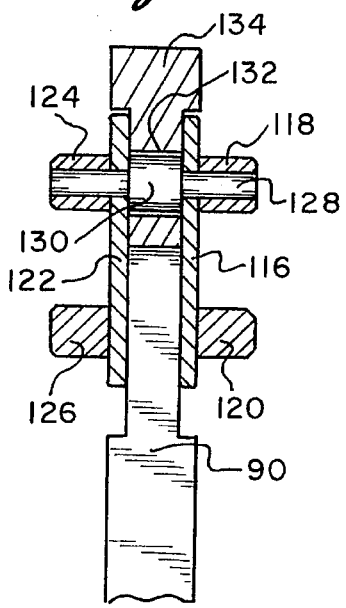
FIG. 8 is cross sectional view taken along lines 8—8 of FIG. 7.
Figure 9:
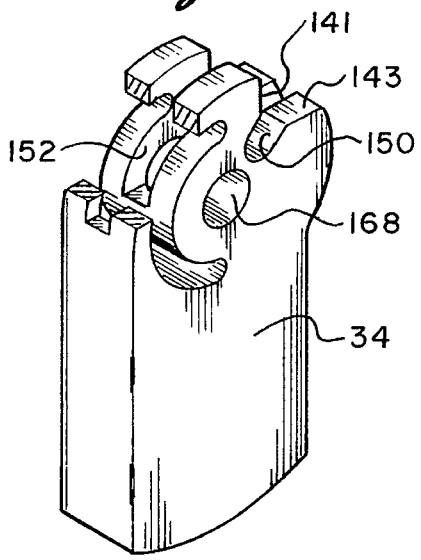
FIG. 9 is a cut-away perspective view of the swinging lock bolt shown in FIG. 7.

The lock cylinder together with a housing of this invention illustrated in FIG. 5 is a standard type while the cylinder illustrated in FIG. 5*a* is an improved version. High security lock cylinders are virtually pick-proof or at least very pick resistant and have keys that are extremely difficult to duplicate owing to patented key control systems. These high security cylinders are very expensive compared to the ordinary, economical, standard mortise lock cylinders. End-users may opt for less protection than offered by high security cylinders and choose a more basic lock cylinder with keys which are readily available at any hardware store. When such is the case, the lock cylinder housing with the mortise lock cylinder as shown in FIG. 5*a* is a more effective and an affordable choice. In new installations when the slimmer slim-line cylinders are needed to avoid alterations to the door frame. The use of the slim-line cylinders increases door's strength of the door because less metal is required to be cut out of the frame during installation and there is no need for heavy duty finish trim. The slim-line cylinder is not illustrated but it is clear that this invention easily allows this type of cylinder to be used.

The use of detachable and reattachable interchangeable lock cylinder housings provides separate detachable sections to accommodate the locking cylinder and its cam member. The housings have substantially more thickness to rigidly support each cylinder. This increase allows a larger set screw to be used as well as a more solid support for same to retain the lock cylinder. This increase of metal mass is possible because of the hollow space within the narrow door stile that heretofore has not been utilized to this advantage. If this lock mechanism and its related components including the lock cylinder housing sections were not detachable it would be impossible to install the lock through the door stile cut out within the face, unless additional cut outs were made. Such cut outs would require additional matching which is labor intensive and expensive and it would affect the structural integrity of the door stile thereby compromising security. Further, expanding the area in which the locking cylinder is housed allows for the design of insertable type lock cylinders which offer a higher degree of security. At the same time this system does not preclude locking cylinders of the high security specialty type which may be desired by the end user. The housing can accept a lock cylinder, which is a combination shape (a modified mortise cylinder) to fit the pre-existing round cut out circular along the front portion of the cylinder and flat section on the rear which is insertable into the lock cylinder housing appropriately formed to receive that portion of the locking cylinder. A retaining set screw is advanced into the lock cylinder body securing it from being pulled out. This type of lock cylinder is relatively inexpensive and has the benefit of being compatible to retrofit. Additionally, this lock cylinder configuration does not require expensive heavy gauge spin-collars, so less expensive "finish trim" collars may be used.

The lock case described below allows passage of through bolts for handles or pulls, armor plates, decorative plates, and the like that require mounting at the location where lock is located as required under the American With Disabilities Act or for future designs to take advantage of this feature. The through bolts will not interfere with the locking mechanism as would occur with prior mechanisms using swinging actuator members. It is possible with this invention because of the rectilinear actuator's compactness as opposed to a swingable actuator which travels across the width of the lock case. These holes can be preformed or they can be drilled when a need presents itself in designated areas or at pre-marked locations.

Figure 1:
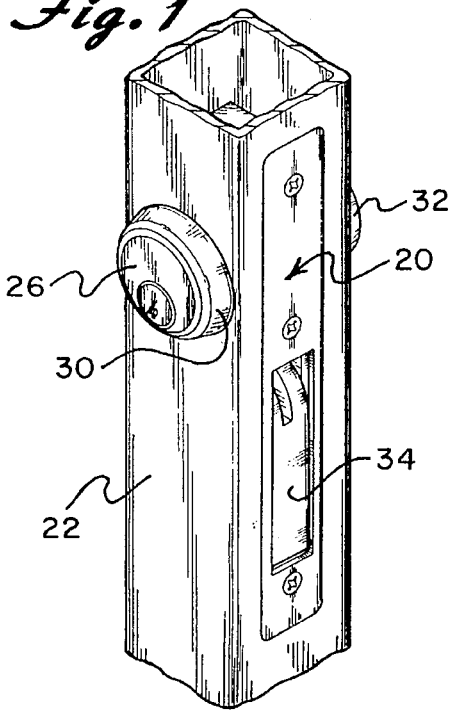
FIG. 1 is a cut-away perspective view of a locking mechanism of the present invention installed in a door stile.
Figure 2:
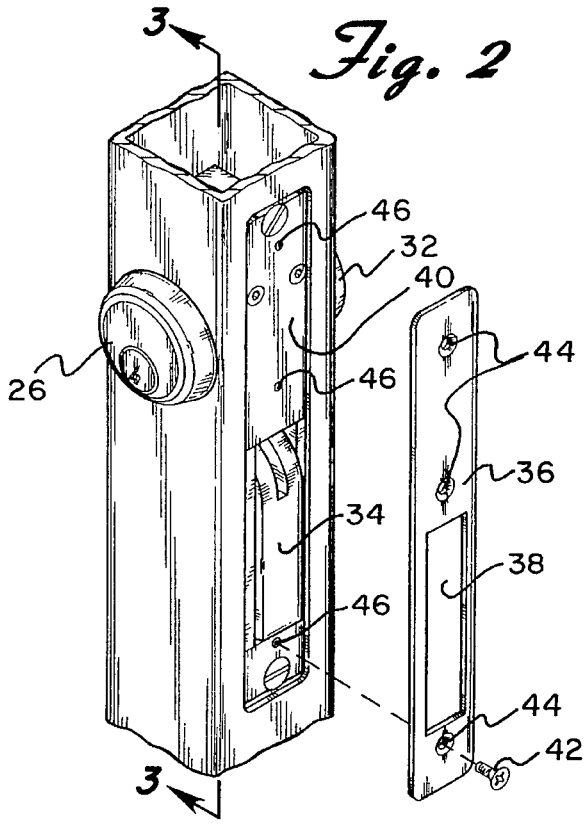
FIG. 2 is a partially exploded view thereof.
Figure 3:
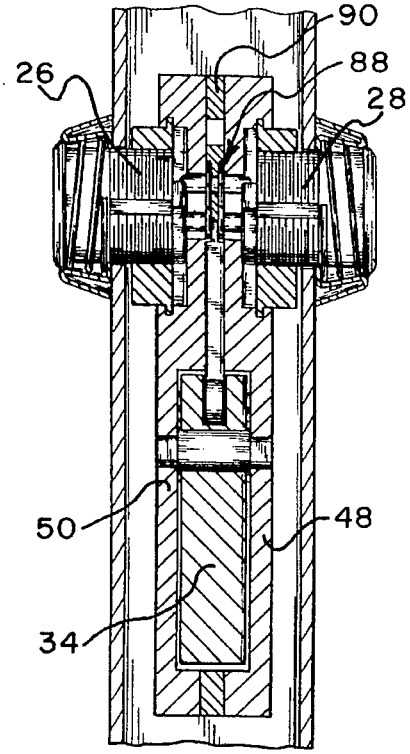
FIG. 3 is cross sectional view taken along lines 3—3 of FIG. 2.
Figure 4:
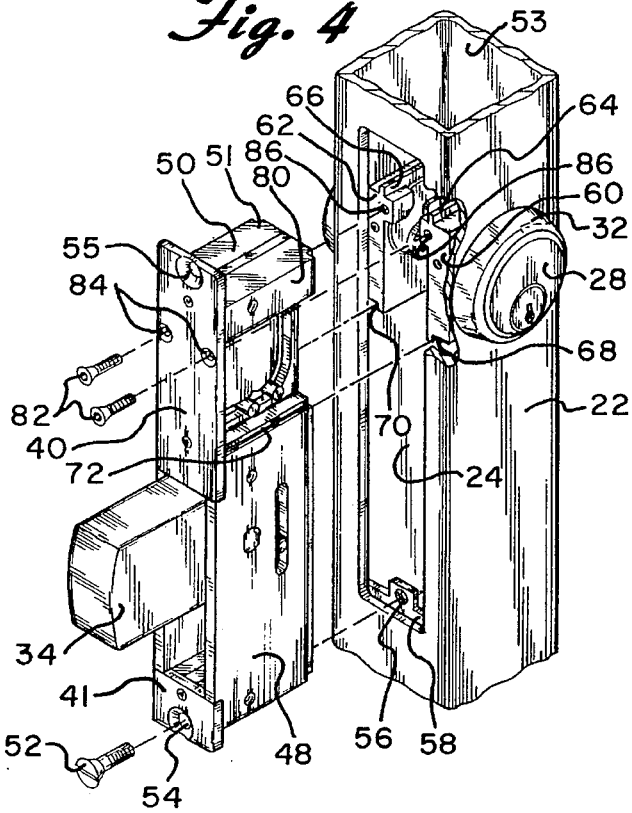
FIG. 4 is a exploded perspective view of a lock cylinder installed and an exploded perspective view of a locking mechanism out of the door casing.
Figure 10:
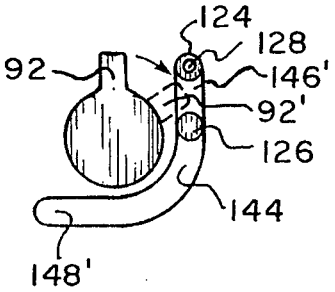
FIG. 10 is diagram of the manually operated cam member of the lock cylinder engaging the split link dual post crank pin in the unlocked position shown in FIG. 12.
Figure 11:
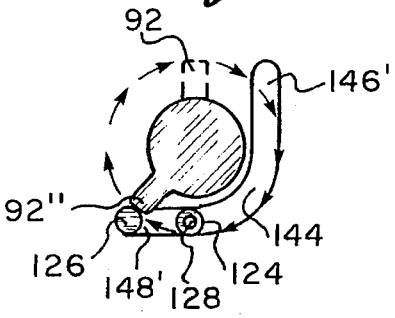
FIG. 11 is diagram of the manually operated cam member of the lock cylinder engaging the split link dual post crank pin in the locked position shown in FIG. 13.
Figure 12:
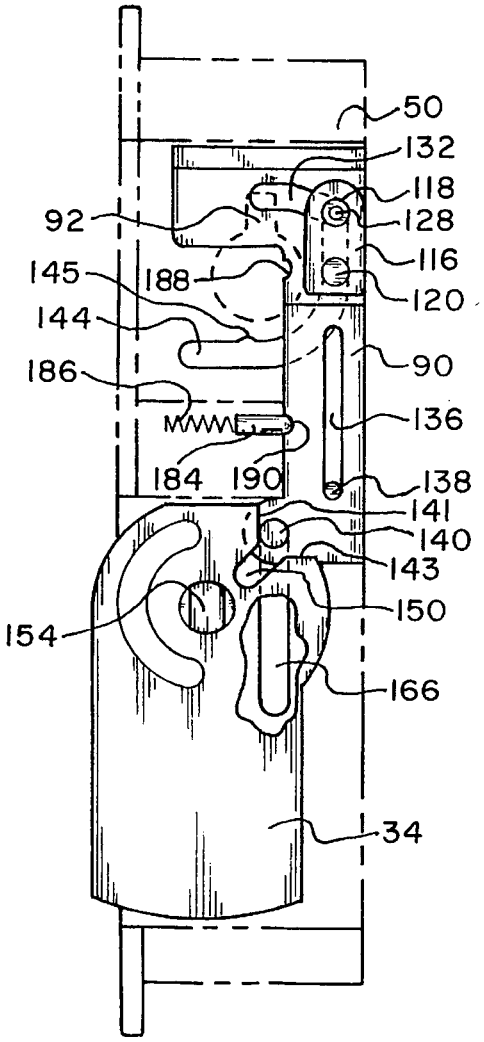
FIG. 12 is diagram of the manually operated cam member on a side plan view of the split link dual post crank pin in the actuator member engaged in the swinging lock bolt in the unlocked position.
Figure 12A:
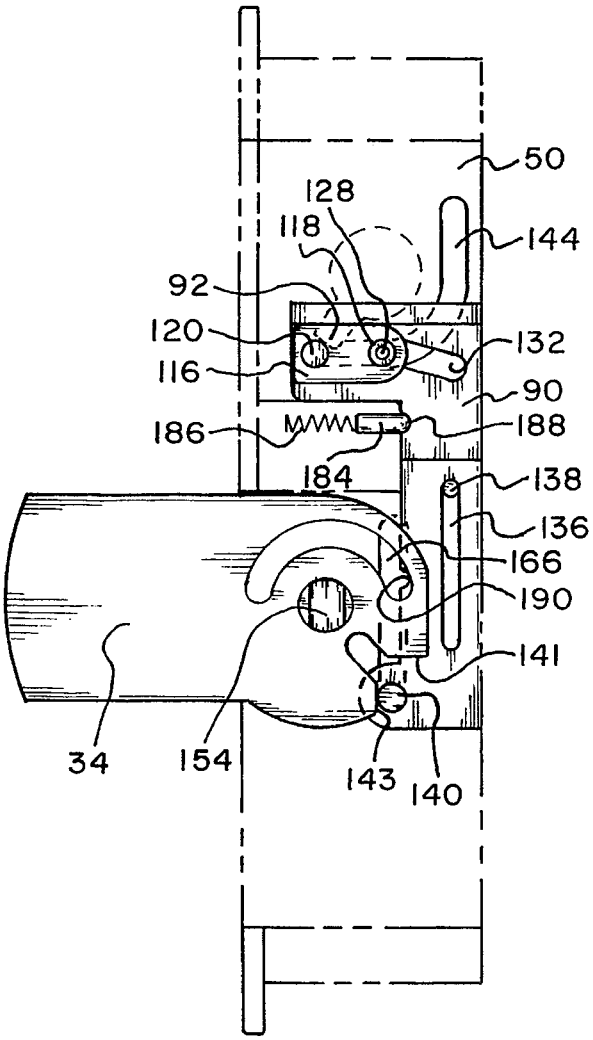
FIG. 12*a* is diagram of the manually operated cam member on a side plan view of the split link dual post crank pin in the actuator member engaged in the swinging lock bolt in the locked position.

As pictured in FIG. 1, locking device 20 is installed in aluminum door stile 22 through opening 24 as shown in the exploded view in FIG. 4. As shown in the external view of FIG. 1, lock cylinders 26 and 28 are operated with a key and each are protected by spin collars 30 and 32. Stainless steel swing bolt 34 extends out of opening 38 in cover plate 36, which is held in place by bolts 42 extending through holes 44 in the plate into threaded holes 46 of the lock case of device 20. As further shown in FIGS. 2, 3, and 4, the lock casing is constructed of upper casing plate 40, lower casing plate 41, right casing housing member 48, left casing housing member 50, right lock cylinder bracket 60 and left lock cylinder bracket 62. Upper casing plate 40 and lower casing plate 41 may be combined into a single plate and can even be cast into housing members 48 and 50. Lengthwise notches 51 out of the rear outer vertical corners of right casing housing member 48 and left casing housing member 50, while not necessary here, allow the lock casing to fit into "pocket" type stiles where a vertical lengthwise pocket is formed in rear wall 53 of stile 22. The casing and most parts are constructed of commercially available ZAMAK alloy unless noted otherwise, although other metals may be used. The casing is connected into stile 20 by bolts 52 (the upper bolt 52 is not shown) extending respectively through hole 54 through lower casing plate 41 and hole 55 through upper section 50 of upper casing plate 40 into SPIROLOX® lock threaded hole 46 in standard stile bracket 58 and into a similar hole and bracket at the top that is hidden in this view. The lock casing is also held in place by bolts 82 extending through holes 84 through upper casing plate 40 and into threaded holes 86, one into right lock cylinder bracket 60 and the other into left lock cylinder bracket 62. Casing housing members 48 and 50 interlock into lock cylinders 60 and 62 through upper tongue ribs 64 and 66 and lower tongue ribs 68 and 70 on brackets 60 and 62, respectively, engaging in lower grooves 72 and 76 and upper grooves 74 and 78 in housing members 48 and 50, respectively. The drive mechanism illustrated in FIGS. 6 through 9 are basically three mechanisms, namely, split link assembly 88, drive actuator 90, and swing bolt 34, all driven by lock cylinder cam 92. The lock cylinder assembly installing lock cylinder 26 includes coil spring 94 urging against the collar of cylinder 26 and stile 22. Male threads 96 on cylinder 26 are engaged in female threads 97 on the inside cylindrical surface of left lock cylinder bracket 62 which is engaged through ribs 66 and 70 into grooves 76 and 78 of left casing member 50. Set screw 98 is threaded into hole 100 to engage groove 102 running longitudinally along cylinder 26. An alternative embodiment of the cylinder and the installation thereof is illustrated in FIG. 5A. In that embodiment cover ring 104 need not be the heavy construction of spin collar 30, as it is merely for decoration. Lock cylinder 26' has a mortise-shape 106 which interfits into opening 108 in lock cylinder bracket 62'. Shoulder 107 of lock cylinder 26' abutting bracket 62' prevents the cylinder from being hammered into the mechanism. In this embodiment, set screw 110 is threaded through hole 112 to extend into hole 114 in the flat side face of cylinder 26'. An identical hole 114' is on the opposite side of the cylinder hidden in this view allows reversibility. This latter cylinder attachment provides a stronger connection and essentially prevents any attempt to twist the cylinder. Brackets 62 and 62' hold lock cylinders 26 and 26' more securely. The threads or the mortise shape guide the lock cylinders into the brackets with leading rails and interlocking with tracks of lock case members 48 and 50, insuring proper alignment of lock cylinder member cam 92 relative to split-link mechanism 88, and lastly with bolts 82 fix the retaining brackets to the lock case upon installing same allowing full reintegration. Split link assembly 88 includes right link 116 and left link 122, both riding on opposite lateral surfaces of drive actuator 90. On right link 116 upper drive post 118 and lower drive post 120 extend laterally and engage in right arcuate slot 142 of right casing housing member 48. Likewise, left link 122 includes upper drive post 124 and lower drive post 125 which extend laterally to the left and engage in left arcuate slot 144. Although links 116 and 122 may be constructed of metal, they are preferably molded of an engineering plastic, such as HOSTALLOY™ injection molded engineering polyolefins from Hoechst Celanese Corp., or other engineering thermoplastic polymers. Posts 118 and 124 are actually cylindrical in shape having a lengthwise center hole extending their full length to accommodate stainless steel crank pin 128 which has expanded cylindrical central section 130 which is the cranking section riding in generally horizontal slot 132 cut through upper section 134 of drive actuator 90. Slot 132 is generally horizontal but preferably angles upwardly to the front at about twenty degrees to a central section and it is then horizontal to the end of the slot. The angle of this pitch, which may range from about ten to about twenty-two and one-half degrees, provides additional movement of linear actuator 90. Rectilinear actuator 90 extends through the center portion of the lock case with multiple guide pins providing at least two point fixing against movement of the actuator other than linearly. Vertical transfer slot 136 is cut through a central section of drive actuator 90 to allow it to ride rectilinearly on horizontal pin 90 extending from an inside face of left casing housing member 50 and extending to and supported in a hole in the opposite side of the the lock case. Bolt pin 140 extends laterally from both sides of drive actuator 90 at a position offset frontwardly from vertical slot 136. Drive posts 124 and 126 on left link 122 ride in left arcuate slot 144 in casing 50. Left arcuate slot 144 includes vertical end section 146' which acts as an escape for post 124 when bolt 34 is in the retracted position and lower horizontal end section 148' of slot 144 acts as an escape for post 126 when bolt 34 is in the locked position. Right arcuate slot 142 includes vertical end section 146 which acts as a similar escape in the retracted position and lower horizontal end section 148 of slot of 142 acts as a similar escape in the locked position, as posts 118 and 120 travel essentially the full length of the slot. As the vertical center line of crank member 128 is moved to at least a dead center position aligned vertically with the vertical center line of pin 140 and beyond, automatic latching occurs. Further movement of crank member 128 connected to its posts along the horizontal escape sections 148 and 148' of slots 142 and 144 latches the mechanism. Notch 145 in the upper edge of lower horizontal end section 148' of slot provides for engagement of post 124 and notch 147 in the upper edge of lower horizontal end section 148 of slot 142 provides for engagement of post 118 to prevent vibration to disengage the locked position of the mechanism. Bolt pin 140 on actuator 90 moves in and out of transverse bolt slot 150 urging bolt 34 to swing upwardly to the locked position and downwardly to the retracted position. Slot 150 is angled radially at a forty-five degree angle upwardly and rearwardly from a horizontal center line of pivot pin 154 when the bolt is in the retracted position. As actuator lever 90 is moved downwardly bolt pin 140 engages slot 150 and swings bolt 34 to the horizontal locking position where slot 150 is angled at a forty-five degree angle downwardly and rearwardly from pivot pin 154. As bolt pin 140 is moved slightly past the forty-five degree angle at the ends of either vertical movement, bolt 34 cannot be moved. Bolt pin 140 engages vertical surfaces 141 (retracted) and 143 (locked) to lock the bolt in the respective positions as will be further illustrated in FIGS. 12 and 12A. As bolt pin 140 engages transfer bolt slot 150, the lower section of drive actuator 90 rides in vertical lateral slot 152 cut downwardly into the top of swing bolt 34. While the swing bolt 34 is shown as a solid block of stainless steel, it may be constructed as a striate type according to U.S. Pat. No. 3,659,885, incorporated herein by reference thereto, or a hook type as disclosed in U.S. Pat. No. 3,695,068, also incorporated herein by reference thereto. Swing bolt 34 swings freely on pivot pin 154 through lateral hole 168. Pivot pin 154 has mortise shape 160 on left end engaged in opening 156 in left casing member 50. The right end of pivot pin 54, mortise shape 162, extends into opening 158 in right casing member 48. Boss 157, as well as a hidden similar boss on member 48, provides spacing and a shim to facilitate the free swinging of bolt 34. These bosses may be replaced with washers or eliminated by the adjustment of tolerances. The left end of bolt pin 140 rides in vertical slot 166 of left casing member 150 and the right end of bolt pin 140 rides in vertical slot 164 through right casing member 48. This movement emphasis the pure rectilinear movement of drive actuator 90 as well as the multiple combinations of bearing surfaces when swing bolt is locked in either position. The lock casing is held together laterally by bolts 176, 176', and 176". Bolt 176 extends through hole 178 in left casing member 50 through hole 180 in upper bracket extension and spacing member 170 that extends rearwardly from section 80 of right casing member 48 and is threadably engaged in hole 182 in right casing member 48. Likewise, bolt 176' extends through median hole 178', hole 180' in lower bracket extension and spacing member 172 from casing plate 40 and then into threaded hole 182' in right casing member 48. Bolt 176" extends through hole 178", hole 180" in bracket extension and spacing member 174 extending rearwardly from lower casing plate 41 and then into threaded hole 182" in right casing member 48. The movement between the retracted position and the locking position of swing bolt 34 and the movement the parts is illustrated in FIGS. 10, 11, 12, and 12A. In FIG. 10, lock cylinder cam 92 is moved from position 92 to position 92' where it engages lower drive post 126 moving it and thus the entire split link mechanism 88 out of upper vertical escape sections 146 and 146' along ninety degree arcuate slots 142 and 144. As drive post 126 is moved, crank pin 128 is also moved along slot 132 moving drive actuator 90 vertically downwardly. As shown in FIG. 11, the lock cylinder cam has moved to position 92" having moved lower drive post 126 and post 120 to escape in the end horizontal escape sections 148 and 148' of arcuate slots 142 and 144. Rotating lock cylinder cam 92 in a counterclockwise direction will cause the cam to engage upper drive post 124 moving split link mechanism 88 upwardly along arcuate slots 142 and 144 and back to the place of starting at the top of escape section 146 and 146'. In FIG. 12, swing bolt 34 is in the retracted position. Bolt pin 140 abuts vertical face 141 on swing bolt 34 which is adjacent to transfer slot 150. Bolt 34 is locked in position as bolt pin 140 rides in vertical slot 166 as well as drive actuator 90 being held as it is only capable of moving in a vertical direction. Detent member 184 urged by spring 186 engages lower detent 190 to prevent vibration and gravity from causing drive actuator 90 drop downwardly. In this position, crank pin 128 is positioned to the rear of generally horizontal slot 132 while upper drive posts 118 and 124 are at the upper most section of arcuate slots 144 and 142, respectively, in the upper vertical escape sections. Drive actuator 90 in its upper most position is guided by pin 138 in vertical slot 136 and pin 140 in slots 164 and 166, as well as the inside bearing surfaces of the casing, providing a three point fix. As lock cylinder cam 92 is rotated clockwise, it engages lower drive post 120 moving drive actuator 90 vertically downwardly such that bolt pin 140 engages into slot 150 swinging bolt 134 upwardly to the position illustrated in FIG. 12A. Further movement of lower drive posts 120 and 126 into the horizontal escape sections 148 and 148' of arcuate slots 142 and 144 causes further downward movement of bolt pin 140 such that engages and abuts face 143 which is now positioned vertically with swing bolt 34 in the locked position. Again, swing bolt 34 is prevented from any movement as face 143 abuts bolt pin 140 which rides in vertical slot 166 and against locked drive actuator 90. No horizontal movement of pin 140 is possible. When crank member 130 is in or past a bottom dead center of the vertical center line of pin 140, no vertical movement of pin 140 is possible. Detent member 184 now engages upper detent 188 to relax spring compression.

While this invention has been described with reference to specific embodiments disclosed herein, it is not confined to the details set forth and the patent is intended to include modifications and changes which may come within and extend from the following claims.

I claim:

1. A locking mechanism for use in a movably mounted door, the door comprising:

(i) a stile with an opening in a vertical face thereof adjacent a face of a frame in which the door is mounted, and (ii) a lock actuating means to operate a cam member thereof rotatable in opposite directions in a vertical arc, the locking mechanism adapted for insertion into the opening in the stile, the locking mechanism comprising:

(A) a lock casing adapted for insertion in the opening in the stile and means to attach the casing in the stile, the casing comprising a front facing out of the opening in the stile when the casing is inserted into the opening in the stile, (B) lock bolt moving alternatively through an opening in the front of the casing from a retracted position to a locking position wherein the bolt in the locking position extends outwardly from the front of the casing, (C) a split link dual post crank pin assembly comprising:

(i) a pair of link members each comprising vertical faces facing in opposite directions, each link member comprising a pair of separated posts extending laterally from said vertical face, wherein a post on each link is aligned with a post on the other link, and (ii) a crank member extending between a pair of the aligned posts, (D) means to guide movement of said assembly of the link members in a vertical arc comprising two arc ends as a pair of the posts on one link is urged by the cam member, first against one post in one direction along the arc and then against the remaining post in an opposite direction along the arc, to allow escape of the posts urged by the cam member at the ends of the arc, and to effect a latched condition at an end corresponding to the locked position, (E) means to transfer movement of the crank member to move the lock bolt, and alternatively secure the lock bolt in the locking position or the retracted position.

2. The mechanism of claim 1 wherein the lock bolt is a swinging lock bolt swinging on a pivot pin, the bolt alternatively swinging through the opening in the casing from a vertical retracted position to a horizontal locking position wherein the bolt in the locking position extends outwardly from the front of the casing.

3. The mechanism of claim 2 wherein the lock bolt is swinging on a fixed pivot pin attached to the casing, the pin having a central pivot axis.

4. The mechanism of claim 1 wherein the means to transfer movement of the crank member to move the lock bolt, and alternatively secure the lock bolt in the locking position or the retracted position comprises:

(A) an actuator member comprising:

(i) a generally horizontal slot in an upper section of the actuator member through which the crank member engages, (ii) a lower section, and (iii) engagement means on said lower section:

(a) to engage the lock bolt as the actuator is moved vertically moving the lock bolt back and forth between the locking position and the retracted position, (b) as the actuator member is moved to an upper position to engage a bearing surface thereof against a first bearing surface of the lock bolt when the lock bolt is in the retracted position, and (c) as the actuator member is moved to a lower position to engage the bearing surface thereof against a second bearing surface of the lock bolt when the lock bolt is in the locking position, and (B) holding means in the casing to hold the actuator member and limit it to freely slide rectilinearly vertically downwardly and upwardly.

5. The mechanism of claim 4 wherein the engagement means on the actuator member comprises a horizontal pin member extending laterally from the lower section of the actuator member in opposite directions, the horizontal pin member being positioned to:

(a) engage a slot in the lock bolt as the actuator is moved vertically moving the lock bolt, (b) abut the first bearing surface of the lock bolt when the lock bolt is in the retracted position, and (c) abut the second bearing surface of the lock bolt when the lock bolt is in the locking position.

6. The mechanism of claim 1 wherein the latched condition of the crank member is positioned at least vertically aligned with or further along the arc than a plane through a vertical center line of the rotating cam member parallel with and toward said opening in the front of the casing.

7. A locking mechanism for use in a movably mounted door, the door comprising:

(i) a stile with an opening in a vertical face thereof adjacent a face of a frame in which the door is mounted, and (ii) a lock actuating means to operate a cam member thereof rotatable in opposite directions in a vertical arc, the locking mechanism adapted for insertion into the opening in the stile, the locking mechanism comprising:

(A) a lock casing adapted for insertion in the opening in the stile and means to attach the casing in the stile, the casing comprising a front facing out of the opening in the stile when the casing is inserted into the opening in the stile, (B) lock bolt moving alternatively through an opening in the front of the casing from a retracted position to a locking position wherein the bolt in the locking position extends outwardly from the front of the casing, (C) an actuator member comprising:

(i) an upper section, (ii) a lower section, and (iii) engagement means on said lower section:

(a) to engage the lock bolt as the actuator is moved vertically moving the lock bolt back and forth between the locking position and the retracted position, (b) as the actuator member is moved to an upper position to engage a bearing surface thereof against a first bearing surface of the lock bolt when the lock bolt is in the retracted position, and (c) as the actuator member is moved to a lower position to engage the bearing surface thereof against a second bearing surface of the lock bolt when the lock bolt is in the locking position, (D) translating means to engage the cam member and the upper portion of the actuator member and translate rotational movement of the cam member to vertical movement of the actuator member, (E) holding means in the casing to hold the actuator member and limit it to freely slide only rectilinearly vertically downwardly and upwardly, (F) disengagement means to allow disengagement of the translating means at ends of movement of the actuator member, and (G) latching means to prevent movement of the lock bolt when the lock bolt is in the retracted position and when the lock bolt is in the locking position.

8. The mechanism of claim 7 wherein the lock bolt is a swinging lock bolt swinging on a pivot pin, the bolt alternatively swinging through the opening in the casing from a vertical retracted position to a horizontal locking position wherein the bolt in the locking position extends outwardly from the front of the casing.

9. The mechanism of claim 8 wherein the lock bolt is swinging on a fixed pivot pin attached to the casing, the pin having a central pivot axis.

10. The mechanism of claim 7 wherein the engagement means on the actuator member comprises a horizontal pin member extending laterally from the lower section of the actuator member in opposite directions the horizontal pin member positioned to:

(a) engage a slot in the lock bolt as the actuator is moved vertically moving the lock bolt, (b) abut the first bearing surface of the lock bolt when the lock bolt is in the retracted position, and (c) abut the second bearing surface of the lock bolt when the lock bolt is in the locking position.

11. The mechanism of claim 7 wherein the translating means comprises:

(a) a split link dual post crank pin assembly comprising:

(i) a pair of link members each comprising vertical faces facing in opposite directions, each link member comprising a pair of separated posts extending laterally from said vertical face, wherein a post on each link is aligned with a post on the other link, and (ii) a crank member extending through and engaging a generally horizontal cross slot in the actuator member between a pair of the aligned posts, and (b) means to guide movement of said assembly in a vertical arc of the link members as a pair of the posts on one link is urged by the cam member, first against one post in one direction along the arc and then against the remaining post in an opposite direction along the arc, and to allow disengagement of the post urged by the cam member at the ends of the arc.

12. A locking mechanism for use in a movably mounted door, the door comprising:

(i) a stile with an opening in a vertical face thereof adjacent a face of a frame in which the door is mounted, and (ii) a lock actuating means to operate a cam member thereof rotatable in opposite directions in a vertical arc, the locking mechanism adapted for insertion into the opening in the stile, the locking mechanism comprising:

(A) a lock casing adapted for insertion in the opening in the stile and means to attach the casing in the stile, the casing comprising a front facing out of the opening in the stile when the casing is inserted into the opening in the stile, (B) a swinging lock bolt swinging on a pivot pin, the pin having a central pivot axis, the bolt alternatively swinging through an opening in the casing from a vertical retracted position to a horizontal locking position wherein the bolt in the locking position extends outwardly from the front of the casing, the lock bolt comprising:

(i) a transverse angled slot in the lock bolt angled radially from the pivot pin upwardly and rearwardly when the lock bolt is in the retracted position, (ii) a first face juxtaposed above an opening of said slot disposed vertically facing rearwardly when the lock bolt is in the retracted position, (iii) a second face juxtaposed below the opening of said slot disposed vertically when the lock bolt is in the locking position, and (iv) a lateral vertical slot opening upwardly when the lock bolt is in the retracted position, and (C) means to transfer movement by the cam member to swing the lock bolt back and forth between the horizontal locking position and the vertical retracted position, and to secure the lock bolt in the locking position by bringing a member to engage the second face of the lock bolt preventing movement thereof when the lock bolt is in the locked position, and secure the lock bolt in the retracted position by bringing said member to engage the first face of the lock bolt preventing movement thereof when the lock bolt is in the retracted position.

13. The mechanism of claim 12 wherein the lock bolt is swinging on a fixed pivot pin attached to the casing, the pin having a central pivot axis.

14. The mechanism of claim 12 wherein the means to transfer movement of the crank member to move the lock bolt, and alternatively secure the lock bolt in the locking position or the retracted position comprises an actuator member comprising:

(i) a generally horizontal slot in an upper section of the actuator member through which the crank member engages, (ii) a lower section, and (iii) engagement means on said lower section:

(a) to engage the lock bolt as the actuator is moved vertically moving the lock bolt back and forth between the locking position and the retracted position, (b) as the actuator member is moved to an upper position to engage a bearing surface thereof against a first bearing surface of the lock bolt when the lock bolt is in the retracted position, and (c) as the actuator member is moved to a lower position to engage the bearing surface thereof against a second bearing surface of the lock bolt when the lock bolt is in the locking position.

15. The mechanism of claim 12 wherein the engagement means on the actuator member comprises a horizontal pin member extending laterally from the lower section of the actuator member in opposite directions, the horizontal pin member being positioned to:

(a) engage a slot in the lock bolt as the actuator is moved vertically moving the lock bolt, (b) abut the first bearing surface of the lock bolt when the lock bolt is in the retracted position, and (c) abut the second bearing surface of the lock bolt when the lock bolt is in the locking position.

16. The mechanism of claim 12 wherein the means to transfer movement by the cam member to swing the lock bolt back and forth between the horizontal locking position and the vertical retracted position, and to secure the lock bolt in the locking position comprises:

(a) a split link dual post crank pin assembly comprising:

(i) a pair of link members each comprising vertical faces facing in opposite directions, each link member comprising a pair of separated posts extending laterally from said vertical face, wherein a post on each link is aligned with a post on the other link, and (ii) a crank member extending through and engaging a generally horizontal cross slot in the actuator member between a pair of the aligned posts, and (b) means to guide movement of said assembly in a vertical arc of the link members as a pair of the posts on one link is urged by the cam member, first against one post in one direction along the arc and then against the remaining post in an opposite direction along the arc, and to allow disengagement of the post urged by the cam member at the ends of the arc.

17. A locking mechanism for use in a movably mounted door, the door comprising:

(i) a stile with an opening in a vertical face thereof adjacent a face of a frame in which the door is mounted, and (ii) at least one lock cylinder housing comprising a horizontal central axis parallel with the opening in the stile when the housing is inserted in the stile, the housing enclosing (iii) a lock actuating means to transfer manual movement directed to said means to rotate a cam member thereof in opposite directions in a vertical arc, the locking mechanism adapted for insertion into the opening in the stile, comprising:

(A) a lock casing adapted for insertion in the opening in the stile and means to attach the casing in the stile, the casing comprising:

(i) a front facing out of the opening in the stile when the casing is inserted into the opening in the stile, and (ii) at least one open horizontal channel aligned normal to said central axis when the housing in inserted in the stile, one for each lock cylinder housing, each channel comprising an open vertical face facing toward the cam member, a horizontal upper side face and a horizontal lower side face, (B) at least one bracket, one for each lock cylinder housing, horizontally slideably engaged in the open channel, the bracket comprising connecting means to connect the lock cylinder housing to the bracket and prevent removal or twisting of the lock cylinder comprising a horizontal opening through which the lock cylinder housing freely slides horizontally along the center axis when the housing is inserted in the stile, (C) tongue and groove means on the side faces of the channel and the bracket to allow the bracket to slide into the casing normal to said central axis and prevent any movement of the bracket parallel to said central axis, (D) means to detachably attach the bracket to the casing, (E) a lock bolt alternatively moving through an opening in the front of the lock casing from a retracted position to a locking position wherein the bolt in the locking position extends outwardly from the front of the casing, and (F) means to translate rotational movement of the cam member to movement of the lock bolt.

18. The mechanism of claim 17 wherein the lock bolt is a swinging lock bolt swinging on a pivot pin, the bolt alternatively swinging through the opening in the casing from a vertical retracted position to a horizontal locking position wherein the bolt in the locking position extends outwardly from the front of the lock casing.

19. The mechanism of claim 18 wherein the lock bolt is swinging on a fixed pivot pin attached to the casing, the pin having a central pivot axis.

20. The mechanism of claim 17 wherein the means to translate rotational movement of the cam member to movement of the lock bolt comprises:

(a) a split link dual post crank pin assembly comprising:

(i) a pair of link members each comprising vertical faces facing in opposite directions, each link member comprising a pair of separated posts extending laterally from said vertical face, wherein a post on each link is aligned with a post on the other link, and (ii) a crank member extending between a pair of the aligned posts, (b) means to guide movement of said assembly in a vertical arc of the link members as a pair of the posts on one link is urged by the cam member, first against one post in one direction along the arc and then against the remaining post in an opposite direction along the arc, and to allow disengagement of the post urged by the cam member at the ends of the arc, and (c) means to translate movement of the crank member to movement of the lock bolt.

21. The mechanism of claim 20 wherein the means to transfer movement of the crank member to move the lock bolt, and alternatively secure the lock bolt in the locking position or the retracted position comprises an actuator member comprising:

(i) a generally horizontal slot in an upper section of the actuator member through which the crank member engages, (ii) a lower section, and (iii) engagement means on said lower section:

(a) to engage the lock bolt as the actuator is moved vertically moving the lock bolt back and forth between the locking position and the retracted position, (b) as the actuator member is moved to an upper position to engage a bearing surface thereof against a first bearing surface of the lock bolt when the lock bolt is in the retracted position, and (c) as the actuator member is moved to a lower position to engage the bearing surface thereof against a second bearing surface of the lock bolt when the lock bolt is in the locking position.

22. The mechanism of claim 21 wherein the engagement means on the actuator member comprises a horizontal pin member extending laterally from the lower section of the actuator member in opposite directions, the horizontal pin member being positioned to:

(a) engage a slot in the lock bolt as the actuator is moved vertically moving the lock bolt, (b) abut the first bearing surface of the lock bolt when the lock bolt is in the retracted position, and (c) abut the second bearing surface of the lock bolt when the lock bolt is in the locking position.

23. The mechanism of claim 17 wherein the connecting means further comprises that the horizontal opening through which the lock cylinder housing freely slides comprises a shape conforming to an outer cross-sectional shape of the lock cylinder that prevents vertical twisting of the lock cylinder within the bracket.

* * * * *